United States Patent [19]

Buscher et al.

[11] 4,306,356

[45] Dec. 22, 1981

[54] PUNCHING MACHINE

[75] Inventors: John H. Buscher, East Amherst; Michael E. Hoffman, Lockport; Michael M. Karalunas, Buffalo, all of N.Y.

[73] Assignee: Eastman Machine Company, Buffalo, N.Y.

[21] Appl. No.: 157,324

[22] Filed: Jun. 9, 1980

[51] Int. Cl.[3] ..... B26F 1/00

[52] U.S. Cl. ..... 30/362

[58] Field of Search ..... 30/362, 361, 367, 358, 30/241

[56] References Cited

U.S. PATENT DOCUMENTS

| | | | |
|---|---|---|---|
| 1,884,668 | 10/1932 | Gury | 30/362 |
| 2,307,424 | 1/1943 | Savage | 30/362 X |
| 2,664,161 | 12/1953 | Schlecht | 30/362 |
| 3,123,912 | 3/1964 | Gury | 30/362 |
| 3,903,599 | 9/1975 | Ray | 30/362 |

*Primary Examiner*—Jimmy C. Peters

*Attorney, Agent, or Firm*—Christel, Bean & Linihan

[57] ABSTRACT

A punching machine comprising a housing, a plunger having a punch at one end, and an electromechanical drive such as a solenoid carried by the housing and operatively connected to the plunger for driving the plunger in a direction along the longitudinal axis thereof when electrically energized to drive the punch into a workpiece and then withdraw the punch therefrom. The plunger is disposed in a housing passage in a manner permitting a degree of rocking movement of the plunger in a plane substantially parallel to the plunger longitudinal axis. A flexible guiding device in the form of a sleeve surrounding the plunger and an O-ring engaging the sleeve and the housing guides the plunger in a direction toward and away from the workpiece and also in the direction of the rocking movement. Electric current is supplied to the electromechanical drive by a circuit including a controlled rectifier connected in controlling relation to the drive and having a gate terminal connected to trigger pulse producing device. The trigger pulse producing device, in turn, is operated by a control circuit in response to control inputs, for example repetitively in response to movement of the machine along the workpiece or, alternatively, singly for only one punching in response to another control input.

11 Claims, 7 Drawing Figures

Fig. 5.
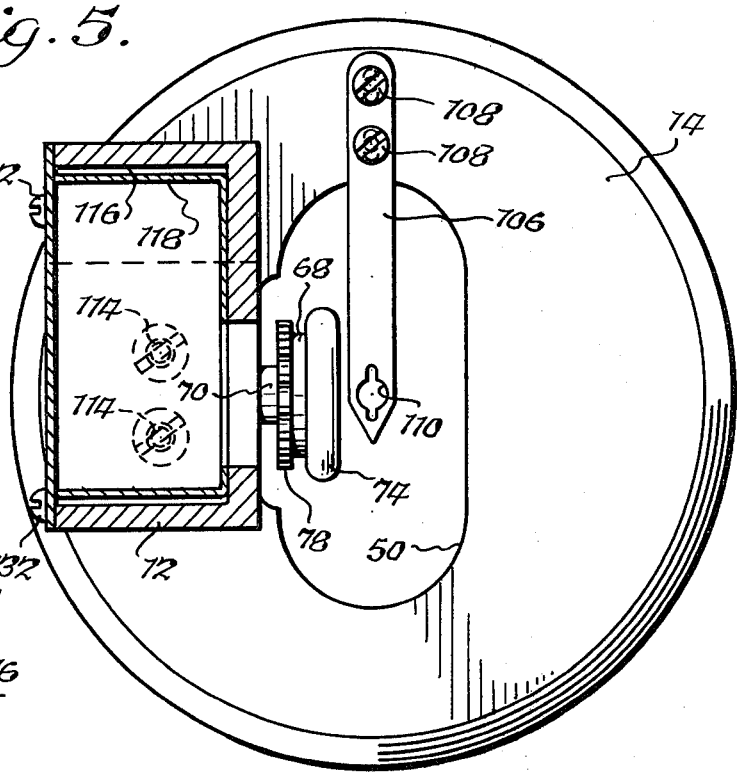
Fig. 6.
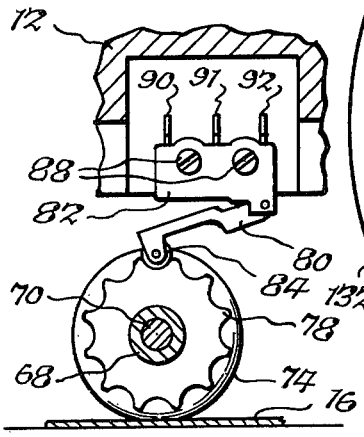
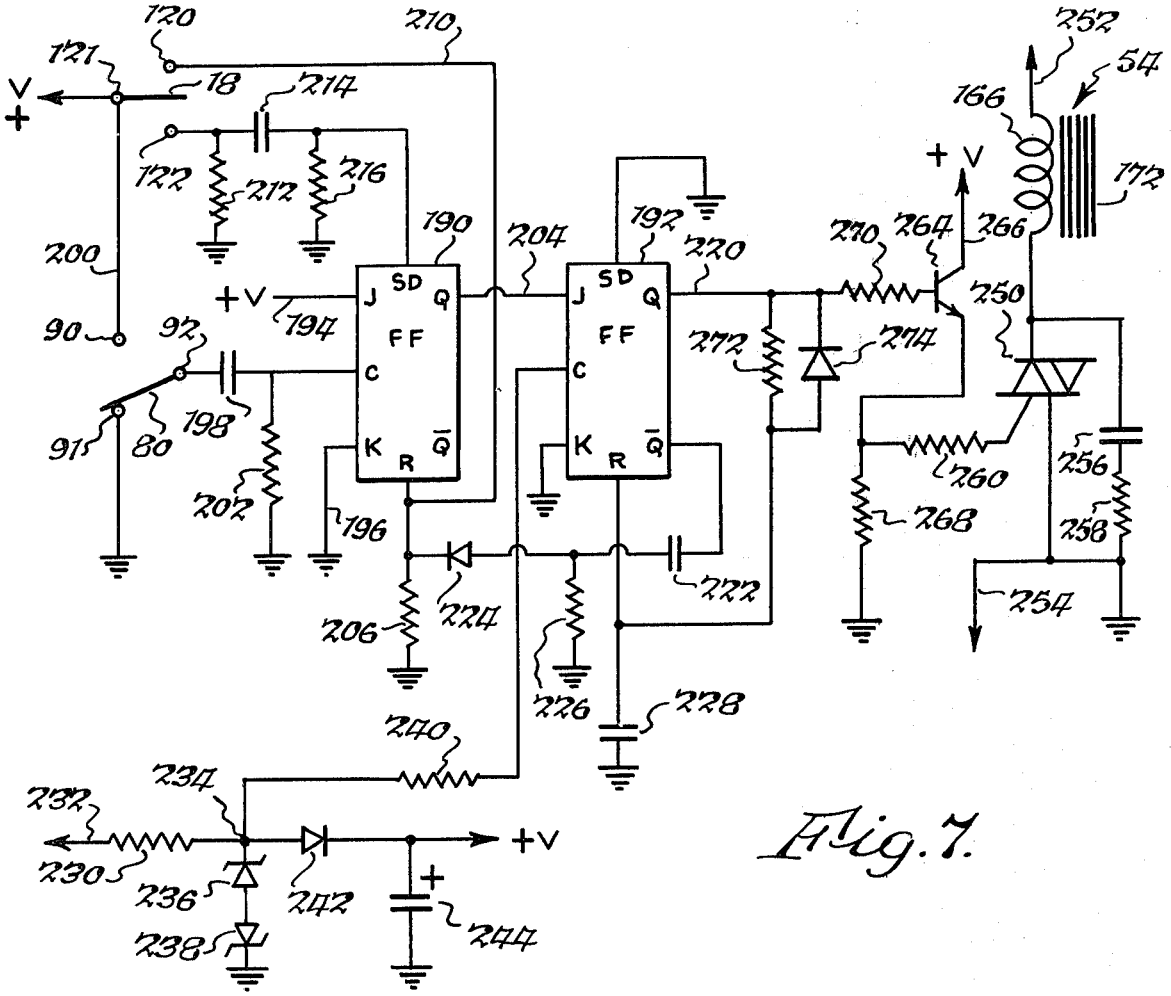
Fig. 7.

PUNCHING MACHINE

BACKGROUND OF THE INVENTION

This invention relates to the art of punching machines, and more particularly to a new and improved punching machine of the type performing a series of punching operations during relative movement between the machine and a workpiece.

One area of use of the present invention is in forming paths or rows of punched holes or indentations through or on paper or like material to form the outlines of patterns which, in turn, are used in cutting cloth or other material. Punching machines have been provided of small size and light weight so as to be easily manipulated by an operator for movement along a workpiece in which a pattern is to be outlined. Such machines are operated by electrical energy to drive the punch in one direction to form the punched hole or indentation in the workpiece, and these machines have been equipped with mechanical switching means for breaking the electric circuit in order to permit withdrawl of the punch from the workpiece after each downward movement.

One problem encountered with such prior art machines is possible tearing of the workpiece when the operator moves the punching machine too rapidly along the workpiece in outlining the pattern. Another problem encountered with such machines is the wear experienced by the mechanical switching arrangement for breaking the electrical circuit after each downward movement of the punch.

SUMMARY OF THE INVENTION

It is, therefore, a primary object of the present invention to provide a new and improved punching machine.

It is a more particular object of the present invention to provide such a punching machine having the capability of rapid movement relative to a workpiece while punching the same in a manner avoiding tearing of the workpiece.

It is a further object of the present invention to provide such a punching machine wherein the punch is returned from the workpiece relatively quickly.

It is a further object of the present invention to provide such a punching machine which avoids the wear associated with mechanical switching arrangements employed for causing return of the punch from the workpiece.

It is a further object of the present invention to provide such a punching machine having improved efficiency and utilization of electrical energy.

It is a further object of the present invention to provide such a punching machine which is relatively simple in construction so as to be economical to manufacture and which is convenient and easy to operate and maintain.

The present invention provides a punching machine comprising a housing, a plunger having a punch at one end, and electromechanical drive means carried by the housing and operatively connected to the plunger for driving the plunger in a direction along the longitudinal axis thereof when electrically energized to drive the punch into a workpiece and then withdraw the punch therefrom. The plunger is disposed in the housing in a manner permitting a degree of rocking movement of the plunger in a plane substantially parallel to the plunger longitudinal axis, and there is provided flexible guiding means for guiding the plunger in a direction toward and away from the workpiece and also in the direction of the rocking movement. Electric current is supplied to the electromechanical drive means by circuit means including a controlled rectifier connected in controlling relation to the drive means and having a gate terminal connected to trigger pulse producing means. The trigger pulse producing means, in turn, is operated by control circuit means in response to control inputs, for example repetitively in response to movement of the machine along the workpiece or, alternatively, singly for only one punching in response to another control input.

The foregoing and additional advantages and characterizing features of the present invention will become clearly apparent upon a reading of the ensuing detailed description together with the included drawing wherein:

BRIEF DESCRIPTION OF THE DRAWING FIGURES

FIG. 5 is an elevational view, partly in section, taken about on line 5—5 in FIG. 2;

FIG. 6 is a fragmentary elevational view, partly in section, taken about on line 6—6 in FIG. 2; and FIG. 7 is a schematic diagram of a control circuit for the punching machine of the present invention.

DETAILED DESCRIPTION OF THE ILLUSTRATED EMBODIMENT

In a basic punching machine, a plunger which fits relatively closely in a housing passage and which has a punch at one end is driven in a direction along the plunger longitudinal axis to drive the punch into a workpiece in response to electrical energization of drive means such as a solenoid. At the end of travel of the plunger into the workpiece a switch is operated to de-energize the solenoid whereupon a spring returns the plunger to a position awaiting the next energization of the solenoid after a given amount of relative movement between the machine and the workpiece. In accordance with this invention, a space is provided between the outer surface of the plunger and the surface of the housing passage for permitting a limited degree of rocking movement of the plunger in a plane substantially parallel to the plunger longitudinal axis, and a flexible guiding means is provided in the space operatively contacting the outer surface of the plunger and the surface of the passage for guiding the plunger toward and away from the workpiece and for guiding the plunger in the direction of the rocking movement. One form of the guiding means is a sleeve seated in the passage surrounding the plunger and a rubber O-ring engaging the sleeve and passage surface. Advantageously, the plunger and punch are allowed to move in the direction of relative movement between the machine and workpiece while the punch still is in the workpiece so that the machine can be moved relatively quickly along the workpiece without tearing the workpiece.

Electric current is supplied to the electromechanical drive means by a circuit including a controlled rectifier having a gate terminal and connected in controlling relation to the drive means, trigger pulse producing means connected to the gate terminal, and control means connected to the trigger pulse producing means for causing operation of the trigger pulse producing means in response to a control input. This advantageously avoids the wear associated with prior mechanical switching arrangements employed for returning the punch from the workpiece and also advantageously provides improved efficiency and utilization of electrical energy. The control means includes a transducer such as a wheel having circumferentially spaced formations for engaging the arm of a microswitch for converting movement between the machine and workpiece into control signals and circuit means for causing operation of the trigger pulse producing means in response to the control signals. The control means also includes a mode control switch and two circuits connecting the switch to the trigger pulse producing means in a manner such that one position of the switch commands generation of only a single trigger pulse to cause only a single punch, another switch position prevents generation of trigger pulses to prevent punching, and a neutral switch position returns control of the machine to the transducer responsive to movement between the workpiece and machine.

Figure 1:
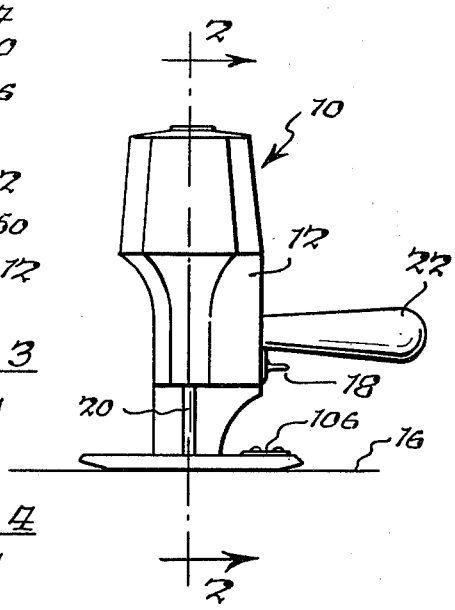
FIG. 1 is an elevational view of a punching machine according to the present invention as it would appear in use.
Figure 3:
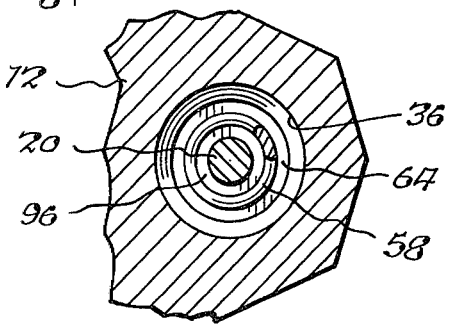
FIG. 3 is a fragmentary sectional view taken about on line 3—3 in FIG. 2.
Figure 4:
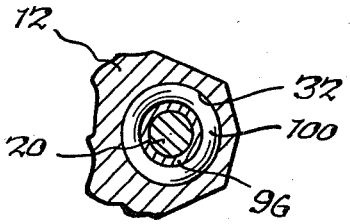
FIG. 4 is a fragmentary sectional view taken about on line 4—4 in FIG. 2.

FIG. 1 illustrates a punching machine 10 according to the present invention as it would appear in a position of use, and the machine shown includes a generally upstanding, vertically disposed housing 12 which is supported on a flat plate 14 which, in turn, rests on the surface of a workpiece 16. The machine 10 operates to punch holes or indentations in the workpiece 16 normally in response to relative movement between the machine and workpiece although the machine includes provision for other modes of operation which can be selected by means of a mode control switch 18. In one area of use of machine 10, workpiece 16 comprises one or a number of sheets of paper or like material wherein the holes or indentations punched by machine 10 are along paths or rows forming outlines of patterns which, in turn, are used in cutting cloth or other material. Punching is accomplished by movement of a plunger 20 having a punch at the end thereof (not shown in FIG. 1) toward and away from the workpiece 16. The machine shown in FIG. 1 is relatively light in weight so as to be portable and it is moved by the user along the workpiece by means of a hand grip 22 extending generally horizontally from one side of housing 12.

Figure 2:
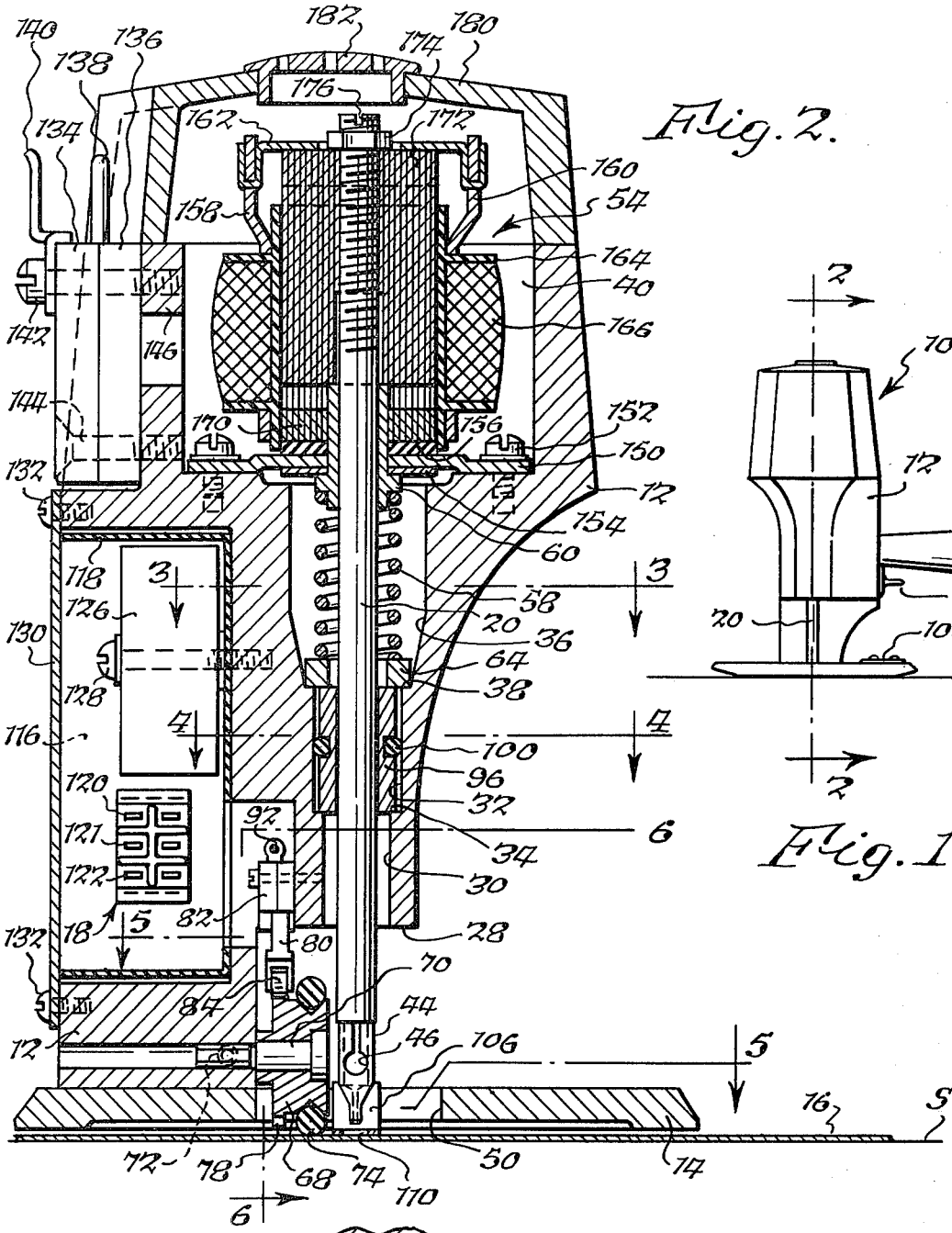
FIG. 2 is an enlarged sectional view taken about on line 2—2 in FIG. 1.

As shown in FIG. 2, the metal housing 12 is fixed to the metal base plate 14 along one side of the housing and along an edge portion of the plate 14. Thus, the lower portion of housing 12 is positioned on plate 14 in a somewhat off-set manner relative to plate 14, and the central portion of the housing terminates in an end surface 28 disposed in a plane substantially parallel to the plane of plate 14 and spaced a distance from the central portion of the plate. The metal housing 12 has a longitudinal passage extending from surface 28 toward the opposite end of the housing, which in the device shown is the top region of the housing. The longitudinal passage has a first portion 30 of substantially constant cross sectional dimension, i.e. diameter, extending inwardly from end face 28. The passage includes a second portion 32 of slightly larger cross section, i.e. diameter, and having an axial length substantially the same as that of the first portion 30. The portions 30,32 meet at an annular shoulder 34. The longitudinal passage includes a third portion 36 having a cross section, i.e. diameter, greater than that of the first and second portions and having an axial length approximately equal to the combined axial length of the first and second portions. The portions 32 and 36 meet at an annular shoulder 38. The longitudinal passage includes a fourth portion of substantially greater cross section defining a chamber 40 at the other end of the housing. The third portion 36 opens to the inner end surface of the chamber 40.

Plunger 20 is in the form of an elongated metal rod having a longitudinal axis and disposed within the housing longitudinal passage for reciprocating movement along the plunger axis and thus toward and away from the workpiece 16. A punching die 44 is attached to the end of plunger 20 adjacent workpiece 16. The punching die 44 is formed of metal, for example annealed tool steel, into a substantially pointed end for making perforations or indentations in the workpiece 16. The die 44 is hollow so as to have an internal passage in communication with the pointed end and is provided with at least one lateral opening 46 permitting egress of the material removed from the workpiece during punching. The end of plunger 20 including punching die 44 is in registry with an opening 50 in the plate 14 and with the pointed end of punch 44 facing the workpiece 16.

The punching machine includes electromechanical drive means carried by housing 12 and operatively connected to plunger 20 for driving the plunger in one direction toward and into workpiece 16 for forming punched holes or indentations through or on the workpiece 16. In the machine shown, the electromechanical drive means comprises a solenoid assembly 54 mounted in the chamber 40 and connected to the end of plunger 20 in a manner which will be described in detail presently. Briefly, according to a regular mode of operation of the machine, solenoid 54 is energized at repetitive intervals in response to movement of the machine along across the workpiece 16 to form a path of punched holes or indentations at equally spaced loactions therein. In other words, energization of solenoid 54 drives punching die 44 by means of plunger 20 toward and into the workpiece 16 to form an opening or indentation through or into the workpiece during a first portion of each interval. During the remaining portion of each interval solenoid 54 is denergized and plunger 20 and die 44 are returned to an initial or rest position by the action of a biasing spring 58 operatively associated with plunger 20. In particular, spring 58 is of the coil type, surrounds plunger 20 in concentric relationship thereto, and is located in the passage portion 36. By way of example, in an illustrative machine with plunger 20 being in the form of a drill rod having an axial length of about $6\frac{5}{8}$ inches and a diameter of about 0.312 inch, spring 58 is of 0.072 inch diameter cadmium plated wire having a spring rate of 45 lb./inch coiled to free length of about $1\frac{1}{4}$ inch with an outer diameter of about 0.6 inch. A shoulder bushing 60 is carried on plunger 20 between one end of spring 58 and the solenoid assembly 54. Bushing 60 is formed with a shoulder on the end facing spring 58 and receives or seats the same as shown in FIG. 2. The opposite end of bushing 60 abuts a portion of the solenoid assembly connected to plunger 20 so as to prevent axial movement of bushing 60 in a direction toward solenoid 54 in a manner which will be described. The opposite end of spring 58 abuts against a metal washer 64 located in passage portion 36 in concentric relation to plunger 20 and supported by the annular seat 38.

Thus, as machine 10 is moved across the workpiece 16, at repetitive intervals the punch 44 is driven into or through the workpiece by energization of solenoid 54 and then removed from the workpiece upon denergization of the solenoid and the action of spring 58. This in turn forms a path of punched holes or indentations at equally spaced locations along the workpiece 16 in a manner which will be described. The machine 10 has capability for other modes of operation, for example providing only a single punch or no punch at all, independent of movement of the machine along the workpiece, selected by operation of mode control switch 18 as will be described in detail presently.

The punching machine further comprises transducer means operatively contacting workpiece 16 for converting relative movement between machine 10 and the workpiece into control signals for ultimately causing repetitive energization of solenoid 54 during successive intervals as the machine is moved across along workpiece 16. A wheel 68 is disposed and located so as to extend into opening 50 of plate 14 and is rotatably mounted on a stud 70, which, in turn, is received in a bore in the lower portion of housing 12 and held therein by means of a set screw 72. Wheel 68 is provided with a circumferentially elastic portion in the form of ring 74 of rubber or like elastic material which seats in a circumferential groove provided in wheel 68. Wheel 68 also is provided with a plurality of circumferentially spaced teeth 78 axially displaced from ring 74 and which are shown more clearly in FIG. 6. The teeth 78 are at equally spaced locations around the circumference of wheel 68 and are in successive operative engagement with the arm 80 of a microswitch 82. In particular, the outer end of switch arm 80 is provided with a roller 84 rotatably connected thereto, and the spacer between the teeth 78 around wheel 68 are arcuate having a curvature which accomodates roller 84. The other end of switch arm 80 is pivotally connected to the housing of switch 82 which, in turn, is secured to machine housing 12 by screws 88. Switch 82 has three terminal pins 90 and 91 and 92 which are connected by wires (not shown in FIG. 6) to the control circuit of the machine, which will be described, for causing repetitive engerization of solenoid 54 during successive intervals as the machine is moved across the workpiece 16. When switch arm 80 is in the position shown in FIG. 6, the switch 82 is in one state and when the roller 84 is in contact with the outer surface of one of the teeth 78, the switch 82 is in another state.

In accordance with the present invention, plunger 20 is disposed within the housing longitudinal passage in a manner allowing some play or movement in the direction of travel of machine 16, in particular, plunger 20 is disposed for rocking movement in a plane parallel to the longitudinal axis of plunger 20. In the machine shown, this rocking or tilting movement is about an axis located near solenoid 54 and disposed generally perpendicular to the longitudinal axis of plunger 20. The outer surface of plunger 20 is spaced from the inner surface of the passage by an amount to permit a small degree of rocking movement. There is provided a flexible guiding means in the space between the outer surface of plunger 20 and the inner surface of the housing longitudinal passage operatively contacting the inner surface of the passage portion and the outer surface of the plunger for guiding the plunger in the direction of reciprocating movement toward and away from the workpiece 16 and also for guiding the plunger in the limited degree of rocking movement in a plane substantially parallel to the longitudinal axis of plunger 20. In the machine shown, the guiding means comprises a metal sleeve 96 through which plunger 20 reciprocates and which is located in the second portion 32 of the longitudinal passage. In particular, one axial end face of sleeve 96 abuts shoulder 34 and the other axial end face abuts washer 64. The inner diameter of sleeve bearing 96 is of the size allowing free reciprocating movement of plunger 20 therethrough. The outer diameter of sleeve 96 is less that the diameter of the passage portion 32. The outer surface of sleeve 96 is provided with an annular groove in which is seated an O-ring 100 of rubber or like flexible material having an outer diameter sufficient to contact the wall surface of passage portion 32. By way of example, in an illustrative machine, sleeve 96 is of bronze having an axial length of about 0.874 inch, an outer diameter of about 9/16 inch and an inner diameter of about 0.314 inch. Ring 100 has an outer diameter of about 11/16 inch, an inner diameter of about 7/16 inch and a height or thickness of about ⅛ inch.

The foregoing arrangement allows the plunger 20 and punching die 44 to move with the direction of travel of the machine across the workpiece while the punching die still is in the workpiece so as to avoid tearing. It also allows the punching die to be returned relatively quickly for the next punching operation. In addition, there is less burden placed on the spring 58 in speed of returning the plunger and die, because for a given thickness of the workpiece material 16, the punching can be performed faster because the punch 44 can remain in the workpiece during the time the spring is retracting without tearing the workpiece. Thus, machine 10 can be moved along, across workpiece 16 relatively quickly during punching without tearing the workpiece. In addition to the combination of sleeve 96 and O-ring 100, other arrangements can be employed, for example the same sleeve but a spring replacing the O-ring 100. As a further alternative, the sleeve 96 might be omitted with provision of an O-ring 100 of sufficient cross section or a spring, in which case an annular groove would be provided in the plunger 20 to receive the O-ring or spring.

The apparatus further includes a punching guide in the form of an elongated strip 106 secured at one end by screws 108 to the upper surface of plate 14 adjacent one end of the oval shaped opening 50 and extending into the opening and terminating substantially centrally thereof. The guide 106 has an opening 110 in the other end which is located to be in registry with the punching die 44. As also shown in FIG. 5, screw fasteners 114 secure the plate 14 to the lower end of housing 12.

As shown in FIGS. 2 and 5, housing 12 is provided with a recess 116 in the side thereof facing away from plunger 20. Recess 116 is provided with a liner of electrically insulative material 118 and includes an opening to the cavity containing microswitch 82. The inner end of mode control switch 18 is exposed to recess 116 and includes three switch terminals 120,121, and 122. Recess 116 contains a control module 126 in the form of components and circuit connections encapsulated in suitable potting compound. The module 126 is secured to housing 12 by a screw 128. Recess 116 is closed by a cover 130 secured to housing 12 by fasteners 132. Various wires (not shown in FIG. 2) connect module 126 to solenoid 54, switch 18 and microswitch 82 in a manner which will be described. Cover 130 is insulated from housing 12.

The housing 12 is provided with another recess which is located at the upper end of housing 12 which accomodates a pair of terminal blocks 134,136 of insulative material having a plurality of electrical contacts sandwiched therebetween, one of which is designated 138. A ground clip 140 is connected to the assembly by a screw 142 which along with a screw 144 secures the terminal blocks 134,136 to the housing 12. An opening 146 in the housing wall provides a path for wires from the contacts 138 to the solenoid 54 and the control module 126 in a manner which will be described.

The solenoid assembly 54 is supported on a plate 150 which is fastened by screws 152 to the inner wall of cavity 40. Plate 150 has a central opening through which bushing 60 is movable, and plate 150 is provided with shock absorbing pads of resilient material 154,156 on opposite sides thereof. The solenoid assembly includes a frame having apair of side walls 158,160 and a top frame 162 having U-shaped formations at opposite ends which fit into slots in the walls 158,160. The solenoid further comprises a bobbin 164 of insulative material carried by the frame and having a coil 166 wound therein. The solenoid also includes a laminated core with the frame and coil. The core includes a fixed or stationary portion 170 adjacent the inner end of the solenoid and abutting the pad 156. The fixed core portion 170 has an opening through which the shoulder bushing 60 is movable. The laminated core includes a movable portion or solenoid plunger 172 which is shown in FIG. 2 in the deenergized condition at an initial or rest position defining an air gap between the lower end face of portion 172 and the upper end face portion 170 as shown in FIG. 2. When the solenoid is energized the plunger 172 moves toward the stationary core portion to close the air gap. The upper end of plunger 20 as shown in FIG. 2 is threaded into solenoid 172 and the outermost end extends through an opening in the frame top portion 162 and is secured by a nut 174. The outer, exposed end face of plunger 20 has a slot 176 so that it may be turned like a screw to adjust the distance between the punching die 44 and the workpiece 16 when the plunger is in the denergized condition for a purpose to be described. The inner surface of solenoid plunger 172 abuts the end face of the shoulder bushing 60 so as to drive the bushing toward the workpiece and compress the spring 58 when the solenoid is energized. The cavity 40 containing the solenoid 54 is closed by a housing end cap 180 held in place by screws (not shown) and having a central opening closed by a plug 182 permitting access to the plunger slot 176 for adjustment.

FIG. 7 shows the control and current supply circuit of the machine of the present invention. The control causes energization of solenoid 54 each time roller 84 engages the outer end of a tooth 78 of wheel to change the state of microswitch 82 as the machine is moved along workpiece 16. The control circuit also allows the machine to be placed under the control of the mode control switch 18 which selects among normal, single punch or no punch operations in a manner which will be described. The circuit of FIG. 7 includes first and second J-K type flip-flops 190 and 192, respectively. The J input of flip flop 190 is connected by a line 194 to a source of DC voltage having a magnitude, for example, of about 6 volts positive, and the K input of flip flop 190 is connected to the circuit ground by a line 196. The clock input C of flip-flop 190 is operatively connected to the output of the transducer comprising the combination of wheel 68 and microswitch 82. In particular, the clock input C is connected through a capacitor 198 to the switch terminal 92 connected to switch arm 80. Switch arm 80 is movable between a contact 91 connected to the circuit ground and another contact 90 connected by a line 200 to the source of positive DC voltage. A resistor 202 also is connected between the clock input of flip-flop 190 and the circuit ground. The true output Q of flip-flop 190 is connected by a line 204 to the J input of flip-flop 192. The complement output $\overline{Q}$ of flip-flop 190 is not connected in the circuit. The reset terminal R of the flip flop 190 is connected through a resistor 206 to the circuit ground. Thus, the state of the flip-flop 190 is controlled by the state of the switch 82 as arm 80 is moved between the contacts 90 and 91 as the machine is moved across workpiece 16.

However mode control switch 18 is connected in controlling relation to flip-flop 190, in particular, in a potentially overriding relation with respect to the state of switch 82. The arm of switch 18 is connected to a contact 121 which, in turn, is connected to the source of DC voltage. Arm 18 is movable between a first contact 120 which is connected by a line 210 to the reset terminal of flip-flop 190, and a second contact 122. Contact 122 is connected through the network including resistor 212, capacitor 214 and resistor 216 to SD terminal of flip-flop 190. When switch arm 18 engages contact 120, the Q output of flip-flop 190 is a logical zero independent of the operation of switch 82. When arm 18 engages contact 122 the Q output of flip-flop 190 is a single logical one output of given time duration, determined by the application of a signal to reset terminal R from a subsequent circuit stage, independent of the operation of switch 82.

The J input of flip-flop 192 is connected to the true output of flip-flop 190, the K input is grounded, the SD terminal also is grounded, the true output Q is connected by line 220 to other portions of the circuit and the complement output $\overline{Q}$ is connected through a capacitor 222 and a diode 224 to the reset terminal of flip-flop 190. The junction of capacitor 222 and diode 224 is connected through a resistor 226 to ground. Reset terminal R of flip-flop 192 is connected through a capacitor 228 to ground.

Flip-flop 192 is clocked at line frequency. In particular, one terminal of a current limiting resistor 230 is connected by conductor 232 to one of the terminal pins 138 from which line voltage is obtained through a conventional cord (not shown) plugged into an outlet. The other terminal of resistor 230 is connected to a circuit terminal 234 which, in turn, is connected through a series combination of Zener diodes 236,238 to the circuit ground. The diodes 236,238 serve to limit the voltage at point 234 to a predetermined magnitude, for example six volts. Terminal 234 is connected through a resistor 240 to the clock terminal C of flip-flop 192. Voltage at terminal 234 also is rectified to provide the positive DC voltage reference previously mentioned. To this end, terminal 234 is connected to the anode of a half-wave rectifier diode 242, the cathode of which is connected through a capacitor 244 to the circuit ground and to the various points in the circuit requiring the DC reference.

The circuit of FIG. 7 further comprises a controlled rectifier 250 connected in series with the solenoid 54 and the line voltage terminals so that the current flows through the solenoid winding 166 only when the controlled rectifier 250 is turned on. In particular, one terminal of solenoid winding 166 is connected by a conductor 252 to one of the terminal pins 138 from which line voltage is obtained as previously described. The other terminal of winding 166 is connected to one terminal of the controlled rectifier 250, the other terminal of which is connected by a conductor 254 to another one of the terminal pins 138 connected to line voltage. The series combination of a capacitor 256 and resistor 258 is connected across controlled rectifier 250. The terminal of resistor 258 which is connected to rectifier 250 also is connected to the circuit ground. Firing or gating pulses to turn on the rectifier 250 are obtained from the following circuit components in combination with flip-flop 192. The rectifier gate terminal is connected through a resistor 260 to the emitter of a transistor switch 264, the collector of which is connected by a line 266 to the source of positive direct voltage. The emitter terminal of transistor 264 also is connected through a resistor 268 to ground. The base terminal of transistor 264 is connected through a resistor 270 to line 220 from the true output Q of flip-flop 192. A resistor 272 is connected across the true and reset terminals of flip-flop 192 and a diode 274 is connected across resistor 272.

In operation, a typical use for machine 10 is in forming paths or rows of punched holes through paper or like material to form the outlines of patterns used for cutting cloth or other material. By way of illustration 40–50 pound kraft paper measuring 0.005–0.006 inch thick is suitable for use as pattern paper. Thus, workpiece 16 comprises one or more sheets of pattern paper and is placed on a supporting surface S which preferably is a solid perfectly flat and smooth table top covered by a pad of inlaid linoleum or the like. Electrical power is supplied to machine 10 by a conventional cord (not shown) plugged at one end into a standard electrical outlet and connected at the other end by means of an electrical connector to the terminal pins 138. Typically, machine 10 will not have an on-off switch and will be ready for operation as soon as the supply cord is connected, i.e. it will start punching as soon as it is moved forward or backward over the workpiece 16 to rotate wheel 68.

The person operating machine 10 grasps handle 22 and holds switch arm 18 in the no punch position, typically the upward position of switch 18 as viewed in FIG. 1, and moves machine 10 along workpiece 16 to the location where it is desired to start punching. During such movement, although wheel 68 is rotated, no punching occurs because solenoid 10 is not energized. The circuit means including terminal 121 connected to the d.c. voltage source, switch arm 18 engaging contact 120, line 210 and the portion of flip-flop 190 controlled by reset terminal R prevents the trigger pulse producing means, i.e. flip-flop 192, transistor 264 and the associated circuit portion, from gating controlled rectifier 250 into conduction. When machine 10 is in position at the desired starting location on workpiece 16, switch 18 is moved to the single punch position, typically the downward position of switch 18 as viewed in FIG. 1. This causes machine 10 to make one punch in workpiece 16 which defines a starting point on the path to be punched. The circuit means including terminal 121 connected to the d.c. voltage source, switch arm 18 engaging contact 122, the RC network including resistors 212,216 and capacitor 214, and the portion of flip-flop 190 controlled by the SD terminal produces only a single logical one output at the true terminal Q of flip-flop 190 causing the trigger pulse producing means to provide only a single trigger pulse to the gate terminal of rectifier 250. This, in turn, results in a one-time energization of solenoid 54 causing a single downward movement of punch 44 into the workpiece and subsequent return by action of spring 58.

After the initial punch has been made, the operator releases switch 18 to the neutral position and then moves machine 10 in a forward or backward direction along the desired path on workpiece 16 which previously was marked by pencil or chalk. Use of guide 106 facilitates following of the line. Movement of machine 10 along the path rotates wheel 68 to repetitively move switch arm 80 between contacts 90,91 as previously described to repetitively clock flip-flop 190. This, in turn, causes corresponding repetitive generation of trigger pulses and repetitive conduction of controlled rectifier 250 to cause repetitive energization of solenoid 54 and repetitive punches as previously described.

The spacing between teeth 78 on wheel 68 determines the number of punches per inch spaced along the path in workpiece 16, a typical number being four punches per inch. Controlled rectifier 250 conducts for only one-half of each cycle of the alternating current applied thereto. As a result there is provided automatic de-engerization of solenoid 54 thereby avoiding the need for prior art mechanical switching arrangements employed for that purpose. Also, the precise mode of conduction of rectifier 250 results in improved efficiency and utilization of electrical energy.

During movement of machine 10 along workpiece at the instant solenoid 54 is de-engerized and spring 58 begins to remove punch 44 from the workpiece, the flexible guiding means according to the present invention allows some play or movement of plunger 20 and punch 44 in the direction of travel of machine 10 thereby avoiding tearing of workpiece 16 as machine 10 is withdrawn therefrom. As a result, machine 10 can be moved relatively faster along a workpiece while punching without causing tearing of the workpiece. Also, there is less burden placed on spring 58 in speed of returning the plunger and punch to the initial or rest position, because for a given thickness of workpiece 16, the punching can be performed faster because punch 44 can remain in the workpiece as machine 10 is moved along the path during the time the spring is retracting the punch without tearing the workpiece. In this connection, by adjusting the initial or rest position of plunger 20 and punch 44 relative to workpiece 16, such as by using a screwdriver slot 176 to turn plunger 20 in its threaded connection, a wide variety of speeds of travel of machine 10 is possible without tearing the workpiece.

By way of example, in an illustration of the circuit of FIG. 7, flip-flops 190,192 are type 4027, resistors 202, 216 and 268 each have a magnitude of 1 kilohm, resistors 226 and 270 each 10 kilohms, resistors 240 and 272 each 100 kilohms, resistor 212 has a magnitude of 1 megohm, resistor 258 a magnitude of 100 ohms, resistor 260 a magnitude of 240 ohms, resistor 230 has magnitudes of 40 kilohms or 80 kilohms for line voltages of 120 volts and 240 volts, respectively, capacitors 198,214,222 and 228 each have a magnitude of 0.01 microfarads, capacitor 244 a magnitude of 10 microfarads and capacitor 256 a magnitude of 0.1 microfarad.

It is therefore apparent that the present invention accomplishes its intended objects. While an embodiment of the present invention has been described in detail, this is for the purpose of illustration, not limitation.

We claim:

1. A punching machine comprising:

(a) a housing including a passage having a surface;

(b) a plunger having a longitudinal axis and provided with a punch at one end, said plunger being disposed in said passage for movement along said plunger axis toward and away from a workpiece with said punch facing the workpiece;

(c) electromechanical drive means carried by said housing and operatively connected to said plunger for driving said punch into the workpiece and withdrawing said punch therefrom;

(d) control means for controlling the operation of said drive means;

(e) a space between the outer surface of said plunger and the surface of said passage for permitting a limited degree of rocking movement of said plunger in a plane substantially parallel to said plunger longitudinal axis; and (f) flexible guiding means in said space operatively contacting the outer surface of said plunger and the surface of said passage for guiding said plunger toward and away from said workpiece and for guiding said plunger in said rocking movement.

2. A punching machine according to claim 1, wherein said housing is small in size and light in weight so as to be portable and further including a hand grip on said housing whereby said machine can be moved by hand along the workpiece.

3. A punching machine according to claim 1, wherein said flexible guiding means comprises a sleeve seated in said passage and receiving said plunger therein for reciprocating movement relative to said sleeve and an O-ring seated in an annular peripheral groove on said sleeve and contacting said passage surface.

4. A punching machine according to claim 1, wherein said plunger is driven from an initial rest position to a final position at which said punch is in said workpiece and further including means for adjusting the initial position of said plunger in a direction along the plunger longitudinal axis to adjust the initial distance between said punch and said workpiece.

5. A punching machine according to claim 1, wherein said control means comprises:

(a) transducer means carried by said housing and operatively contacting the workpiece for converting relative movement between the machine and workpiece into control signals;

(b) a controlled rectifier having a gate terminal and connected in controlling relation to said drive means for controlling the supply of electric current to said drive means; and (c) circuit means connected to said transducer means and to said rectifier gate terminal for gating said rectifier into conduction in response to said control signals.

6. A punching machine according to claim 5, further including:

(a) a mode selection switch carried by said housing and having a neutral position, a first operative position and a second operative position;

(b) said switch being connected to said control means in a manner such that when said switch is in said neutral position said rectifier is under control of said transducer means;

(c) first means connected to said switch and coupled to said rectifier gate terminal for preventing conduction of said rectifier when said switch is in said first position; and (d) second means connected to said switch and coupled to said rectifier gate terminal for limiting conduction of said rectifier to a single instance resulting in a single punch when said switch is in said second position.

7. A punching machine comprising:

(a) a housing having a passage therein;

(b) a plunger provided with a punch at one end and disposed in said housing passage for movement toward and away from a workpiece with said punch facing the workpiece;

(c) electromechanical drive means carried by said housing and operatively connected to said plunger for driving said punch into the workpiece when electrically energized and withdrawing said punch therefrom;

(d) circuit means adapted for connection to an electrical source for supplying electric current to said electromechanical drive means, said circuit means including a controlled rectifier having a gate terminal and connected in controlling relation to said drive means and trigger pulse producing means connected to said gate terminal; and (e) control means connected to said trigger pulse producing means for causing operation of said trigger pulse producing means in response to a control input.

8. A punching machine according to claim 7, wherein said control means comprises:

(a) transducer means carried by said housing and operatively contacting the workpiece for converting relative movement between the machine and workpiece into control signals; and (b) circuit means connected between said transducer means and said trigger pulse producing means for causing production of a trigger pulse in response to a control signal.

9. A punching machine according to claim 7, wherein said control means comprises:

(a) a switch having a neutral position, a first operative position and a second operative position;

(b) first circuit means connected to said switch and to said trigger pulse producing means for preventing production of trigger pulses when said switch is in said first position; and (c) second circuit means connected to said switch and to said trigger pulse producing means for allowing production of only a single trigger pulse when said switch is in said second position.

10. A punching machine according to claim 7, wherein said control means comprises:

(a) transducer means carried by said housing and operatively contacting the workpiece for converting relative movement between the machine and workpiece into successive control signals during such movement;

(b) a JK flip-flop having the J input thereof connected to a position bias voltage, the K input thereof connected to ground, the true input thereof connected in controlling relation to said trigger pulse producing means and having clock, SD and reset inputs;

(c) means for applying said control signals from said transducer means to said clock input of said flip-flop whereby in response to each control signal said flip-flop produces a true output causing operation of said trigger pulse producing means;

(d) a mode selection switch having a neutral position, a first operative position and a second operative position;

(e) first circuit means connecting said switch to said flip-flop reset terminal for applying a signal to said reset terminal when said switch is in said first position to inhibit production of a true output by said flip-flop thereby inhibiting operation of said trigger pulse producing means; and (f) second circuit means connecting said switch to said flip-flop SD terminal for applying a signal to said SD terminal when said switch is in said second position to cause said flip-flop to produce only a single true output whereby said trigger pulse producing means triggers said controlled rectifier only once.

11. A punching machine according to claims 7 or 10, wherein said trigger pulse producing means comprises:

(a) a transistor switch having base, collector and emitter terminals, said collector and emitter terminals being connected in series with said controlled rectifier gate terminal and a source of gating voltage for said rectifier;

(b) a JK flip-flop having the J input thereof connected to said control means, the K input thereof connected to ground, the true output thereof connected to said base terminal of said transistor switch, the SD output thereof connected to ground, the reset output being connected to the true output thereof, and having clock and complement outputs;

(c) means for coupling said complement output of said flip-flop to said control means; and (d) means connected to said clock input of said flip-flop for providing clock pulses having the same frequency as the current supplied to said controlled rectifier.

* * * * *

UNITED STATES PATENT AND TRADEMARK OFFICE

CERTIFICATE OF CORRECTION

PATENT NO. : 4,306,356

DATED : December 22, 1981

INVENTOR(S) : John H. Buscher, Michael E. Hoffman, Michael M. Karalunas

It is certified that error appears in the above-identified patent and that said Letters Patent are hereby corrected as shown below:

In the Claims:

Claim 10, line 9 change "position" to --positive--.

Signed and Sealed this

Sixteenth Day of March 1982

[SEAL]

*Attest:*

GERALD J. MOSSINGHOFF

*Attesting Officer*

*Commissioner of Patents and Trademarks*